US012453886B2

(12) United States Patent
Bardunias

(10) Patent No.: US 12,453,886 B2
(45) Date of Patent: Oct. 28, 2025

(54) REMEDIAL DEVIATION DEVICE FOR HAND, WRIST AND FOREARM REHABILITATION AND TRAINING

(71) Applicant: Dirty Mike Golf, LLC, Smithtown, NY (US)

(72) Inventor: Michael Bardunias, Smithtown, NY (US)

(73) Assignee: Dirty Mike Golf, LLC, Smithtown, NY (US)

( * ) Notice: Subject to any disclaimer, the term of this patent is extended or adjusted under 35 U.S.C. 154(b) by 181 days.

(21) Appl. No.: 18/180,539

(22) Filed: Mar. 8, 2023

(65) Prior Publication Data

US 2024/0299800 A1 Sep. 12, 2024

(51) Int. Cl.

| | |
|---|---|
| ***A63B 21/00*** | (2006.01) |
| ***A63B 21/072*** | (2006.01) |
| ***A63B 23/035*** | (2006.01) |
| ***A63B 23/12*** | (2006.01) |

(52) U.S. Cl.

CPC ..... *A63B 21/4035* (2015.10); *A63B 21/072* (2013.01); *A63B 21/153* (2013.01); *A63B 21/4049* (2015.10); *A63B 23/03525* (2013.01); *A63B 23/1281* (2013.01)

(58) Field of Classification Search

CPC . A63B 21/4035; A63B 21/072; A63B 21/153; A63B 21/4049; A63B 23/03525; A63B 23/1281

See application file for complete search history.

(56) References Cited

U.S. PATENT DOCUMENTS

| | | | | |
|---|---|---|---|---|
| 4,438,920 | A * | 3/1984 | Veillette | A63B 23/14 482/93 |
| 5,046,727 | A * | 9/1991 | Wilkinson | A63B 21/015 428/909 |
| 5,976,059 | A * | 11/1999 | Brown | A63B 21/4049 482/121 |
| 6,099,437 | A * | 8/2000 | DeMers | A63B 21/153 482/46 |
| 6,338,702 | B1 * | 1/2002 | Jordan | A63B 21/072 482/93 |
| 7,753,827 | B1 * | 7/2010 | Emick | A63B 21/00181 482/44 |
| 9,387,360 | B2 | 7/2016 | Niederman | |
| 10,384,096 | B1 * | 8/2019 | Aery | A63B 21/075 |
| 2002/0137599 | A1 | 9/2002 | Kuo | |
| 2010/0267523 | A1 | 10/2010 | Wilkinson et al. | |
| 2012/0245004 | A1 * | 9/2012 | Bremer | A63B 23/14 482/129 |

(Continued)

OTHER PUBLICATIONS https://discover.hubpages.com/education/What-Is-Carbon-Fiber-Uses-of-Carbon-Fiber (Year: 2024).*

*Primary Examiner* — Andrew M Kobylarz

(74) *Attorney, Agent, or Firm* — Offit Kurman; Gregory A. Grissett

(57) ABSTRACT

A hand, wrist and forearm remedial deviation roller device which allows for a complete therapeutic and training exercise program to build and increase the muscles of the hands, wrists, and forearms through relative rotation of perpendicular adjustable phased handle grips and which is portable, simple in design, and inexpensive to construct.

16 Claims, 4 Drawing Sheets

(56) References Cited

U.S. PATENT DOCUMENTS

| | | | | |
|---|---|---|---|---|
| 2012/0277072 | A1* | 11/2012 | Coffey | A63B 21/00189 482/122 |
| 2017/0021219 | A1* | 1/2017 | Kelly | A63B 21/4033 |
| 2024/0261631 | A1* | 8/2024 | Shechter | A63B 21/4035 |

* cited by examiner

REMEDIAL DEVIATION DEVICE FOR HAND, WRIST AND FOREARM REHABILITATION AND TRAINING

BACKGROUND OF THE INVENTION

1. Field of the Invention

The present invention relates generally to a specialized exercise and therapeutic remedial deviation device for hand, wrist and forearm training. More specifically the present invention relates to a forearm/wrist roller having perpendicular 90 degree phased handles for a more improved training of the hand, wrist and forearm.

2. General Background

There are a variety of exercise devices designed to target specific muscle groups in order to allow the user to customize a workout according to his or her personal preference and athletic ability. Additionally, such devices are ideal for rehabilitation purposes as they allow the user to slowly and gradually strengthen specific regions of the body. Portable and/or at-home exercise devices are becoming increasingly popular due to their customizable nature and low maintenance. There exists a variety of devices designed to target a variety of muscle groups. An objective of the present invention is to provide an exercise device that targets and engages the muscles of the hand, wrist and forearm.

The present invention is a portable and adjustable exercise device for the wrist and forearm. The present invention utilizes two rotating handles in conjunction with an adjustable resistance mechanism in order apply a torsional force onto the user's arm. More specifically, the user simply grabs the handles and twist them repeatedly in either clockwise or counter clockwise direction in order to force the muscles of the forearm to engage and compensate. This action is ideal for martial arts training, climbing training, and therapeutic purposes in regards to tendonitis, also known as tennis elbow. Additionally, the present invention may be used to engage and strengthen additional muscles of the arm by acting as a simple weight. The overall weight of the present invention may be adjusted according to the user's training regimen and portability requirements.

Current forearm/wrist rollers typically include a single roller approximately 12-15 inches long with a spool centered on the roller to hold a cord tied to a weight. A user will typically grasp the roller placing each hand palm down on each side of the center spool and wind the roller to raise or lower the tethered rope in order to train the hands, wrist and forearm.

Some existing forearm training devices include rounded handles at the distal ends thereof. However, these handles do not allow for complete radial training of the hands, wrist and forearm hence lacking a whole lower arm training regimen. As such there is a need for an improved hand, wrist and forearm roller device to provide remedial deviation training and exercises.

3. Objects of the Invention

It is an object of the present invention to disclose a remedial deviation device to provide a hand, wrist and forearm roller device that will allow for complete and comprehensive lower arm training and exercises.

Another object of the present invention is to provide a hand, wrist and forearm training device with a perpendicular distally opposed ergonomic grips to promote grip strength by placing a user's hands and fingers into a position to promote finger flexion.

Another object of the present invention is to provide a hands, wrist and forearm training device with hand grips that allow for finger dexterity, rotation and repetition in order to reduce muscle fatigue of finger and wrist flexors.

A further object of the present invention is to provide a hand, wrist and forearm training device that allows a user's thumbs to be in respective positions of opposition which is an optimal and functional hand position for training for sports such as golf, tennis, baseball and other sports.

SUMMARY OF THE INVENTION

The present invention is related to portable specialized exercise equipment. More specifically, the present invention is a free-weight exercise device which targets and engages the muscles of the forearm through the application of a torsional force on the hands of the user. The resistance, i.e. torsional force, felt by the user is easily adjustable, thus allowing the user to create an exercise routine that is tailored to his or her needs and athletic ability. In addition to engaging the wrist and forearm of the user, the present invention also works as a simple adjustable free-weight, thus engaging additional muscle groups of the arm.

The present invention includes a remedial deviation device to provide a hand, wrist and forearm roller device that will allow for complete and comprehensive lower arm training and exercises that includes perpendicular distally opposed ergonomic grips to promote grip strength by placing a user's hands and fingers into a position to promote finger flexion. The present invention includes moveable hand grips phased 90 degrees to allow for finger dexterity, rotation and repetition in order to reduce muscle fatigue of finger and wrist flexors.

The present invention also includes hand grips that allow a user's thumbs to be in respective positions of opposition which is an optimal and functional hand position for training for sports such as golf, tennis, baseball, lacrosse and other sports.

In a first embodiment, the present invention includes remedial deviation training device including a central roller bar, a pair of handles adjustably affixed to the roller bar, where each one of the pair of handles is disposed as a respective distal end of the roller bar, the handles having a substantially arcuate shape perpendicular to the roller bar optimally sized for remedial deviation training of a user's hands, wrists and forearms; and a spool, releasably affixed to the roller bar substantially central thereto, the spool structured and arranged to releasably secure a tether cord designed to hold a weighted object having a predetermined weight, where, upon a user's rotation of the handles along a central axis of the roller bar, the spool rotates along with the roller bar and collects the cord in a rolled up manner so that the user may train his or her hands, wrists and forearms, by rotating the handles in one direction to elevate the weighted object and then reverse the rotation of the handles bar and lower the weighted object.

In some embodiments the roller bar is a hollow cylinder having open ends and each one of the pair handles includes a mating portion for adjustably connecting with the open distal ends of the roller bar.

In some embodiments, the roller bar includes a set of bar notches proximally located near the distal ends thereof where the mating portion includes a set of adjustable protuberances for respectively mating with the set of roller bar notches.

In some embodiments include a set of bar notches and the set of adjustable protuberances are structured and arranged so that the handles can be releasably affixed to the roller bar out of phase relative to one another.

In some embodiments the pair of handles are formed of a malleable material and the pair of handles include ergonomic finger grips.

In some embodiments the adjustable protuberances are spring loaded.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE PREFERRED EMBODIMENTS

The present disclosure will now be described more fully with reference the to the Figures in which an embodiment of the present disclosure is shown. The subject matter of this disclosure may, however, be embodied in many different forms and should not be construed as being limited to the embodiments set forth herein.

The present invention is related to portable specialized exercise equipment. More specifically, the present invention is a free-weight exercise device which targets and engages the muscles of the forearm through the application of a torsional force on the hands of the user. The resistance, i.e. torsional force, felt by the user is easily adjustable, thus allowing the user to create an exercise routine that is tailored to his or her needs and athletic ability. In addition to engaging the wrist and forearm of the user, the present invention also works as a simple adjustable free-weight, thus engaging additional muscle groups of the arm.

The present invention includes a remedial deviation device to provide a hand, wrist and forearm roller device that will allow for complete and comprehensive lower arm training and exercises that includes perpendicular distally opposed ergonomic grips to promote grip strength by placing a user's hands and fingers into a position to promote finger flexion. The present invention includes moveable hand grips phased 90 degrees to allow for finger dexterity, rotation and repetition in order to reduce muscle fatigue of finger and wrist flexors.

An advantage and feature of the present invention also includes hand grips that allow a user's thumbs to be in respective positions of opposition which is an optimal and functional hand position for training for sports such as golf, tennis, baseball, lacrosse and other sports.

Figure 1:
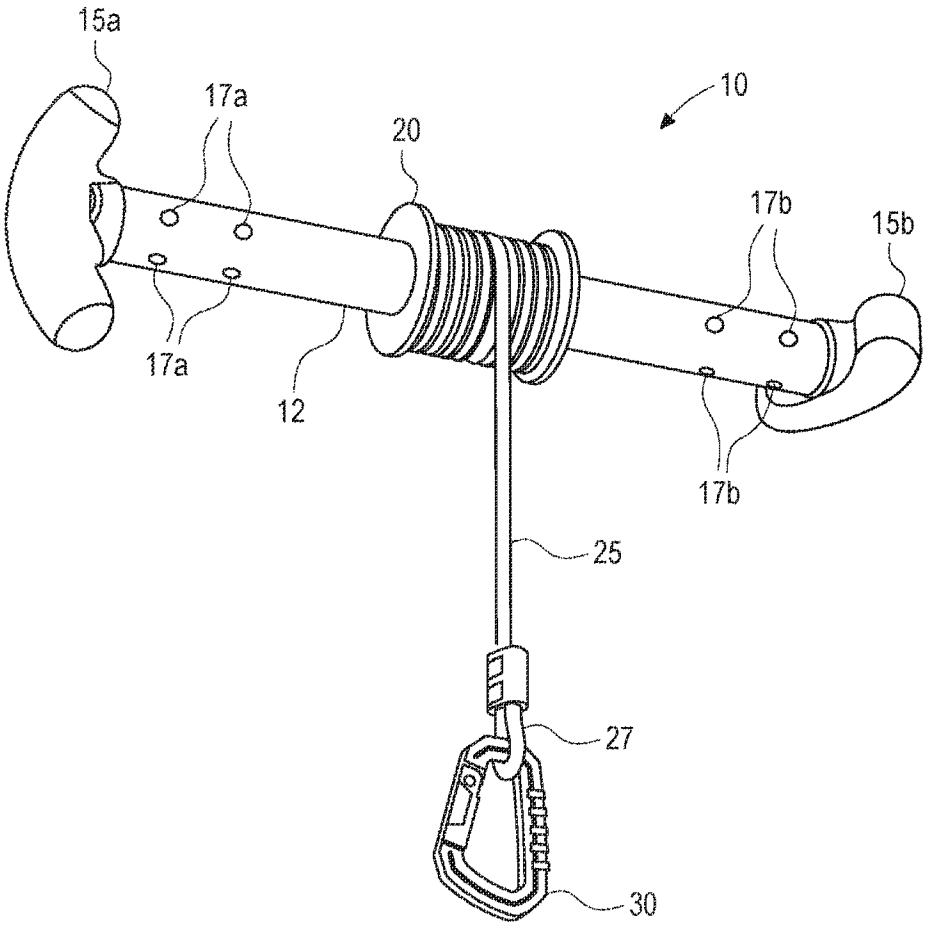
FIG. 1 shows a perspective view of the remedial deviation device according to one embodiment of the present invention.

Referring now to FIG. 1 there is shown remedial deviation device 10 which includes roller bar 12 having handle grips 15*a* and 15*b* respectively disposed on the distal ends thereof. Spool 20 is centrally located on roller bar 12 and includes a releasably tethered cord 25 for spooling onto spool 20 by the rotating action of a user upon handle grips 15*a* and 15*b*. Cord 25 may have a spring lock clip 27 in order to engage a weight to be rolled up and down by the user as part of a training regimen. It will be apparent to those skilled in the art that additional means of releasably affixing a weight to cord 25 are also applicable in order to take advantage of the portability features the remedial deviation device 10.

Each handle grip 15 is movably affixed to roller bar 12 via a standard resalable affixing means through holes 17*a* and 17*b*. Handle grips 15*a* and 15*b* are movable in respective positions so that the handles can be set upon roller bar 20 in parallel or out of phase by up to 90 degrees or perpendicular. The relative angle of the handle grips 15 can be set according to a preferred training or therapeutic exercise to accomplish a user's strength or flexion goals.

Handle grips 15 are preferably substantially perpendicular with an arcuate curvature to form an efficient and ergonomic design, providing ergonomic grips 15*c* and 15*d*. This allows for user to grasp and release the handle grips as the user is manipulating the device 10 during a training sessions.

The preferred ergonomic grip of the invention promotes grip strength, and places a user's fingers into a position to promote finger flexion, at the distal interphalangeal (DIP) joint, the proximal interphalangeal (PIP) joint and metacarpophalangeal (MIP) joint of the fingers which is not provided for in prior art devices.

A reciprocal pattern of use for a training regimen including "grip, release, grip" allows for finger dexterity, range of motion and repetition. This process reduces muscle fatigue of the smaller muscle groups, such as the wrist and finger muscle. In addition, reciprocal motion reinforces a neurological motor plan. The arcuate grips in a offset phased positions allow a user's thumb to be located in more of a position of opposition which is an operational preferred functional hand position for training, rehabilitation and exercising the hand, wrist and forearm muscles.

Figure 2:
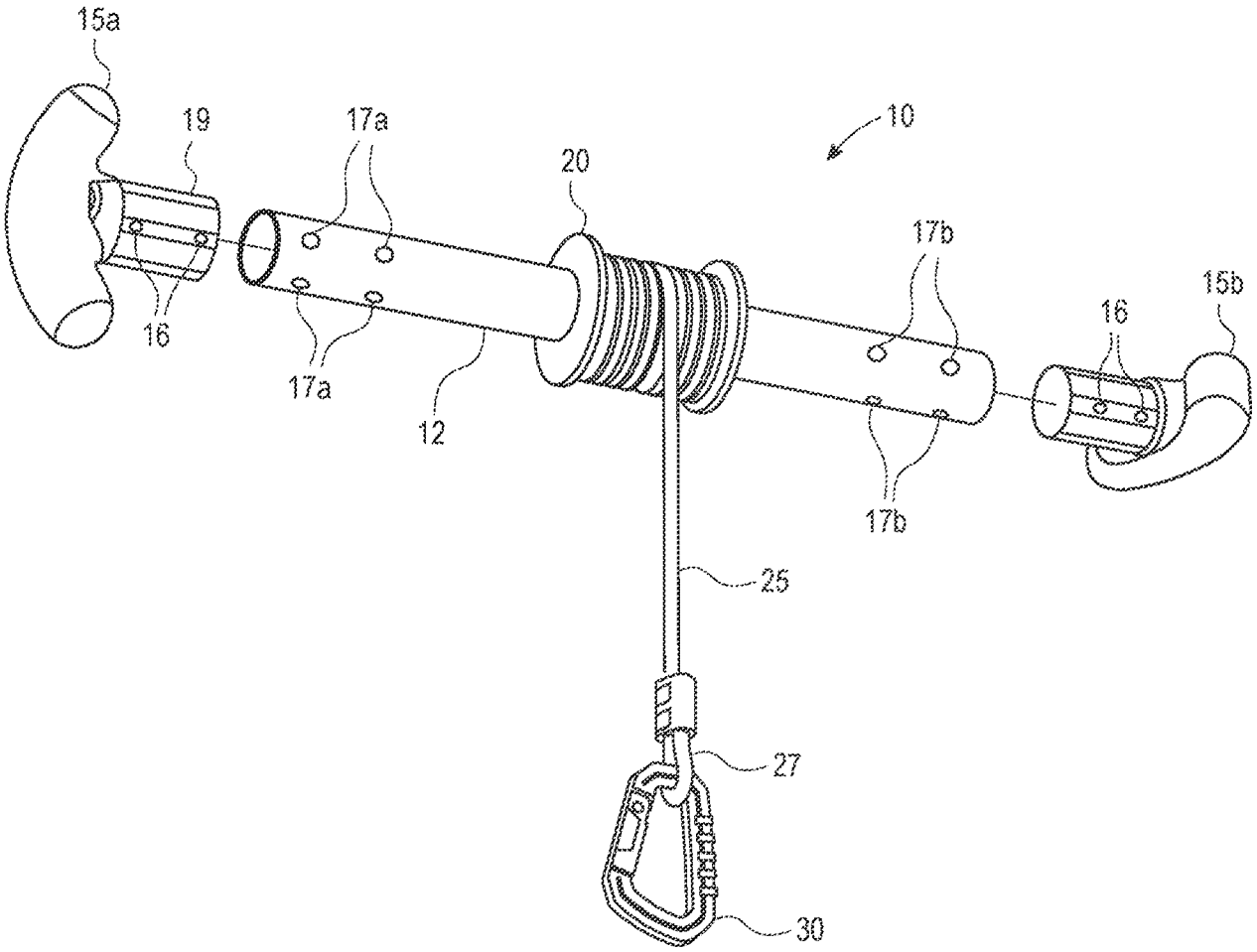
FIG. 2 shows a perspective exploded view of the remedial deviation device according to one embodiment of the present invention.
Figure 3:
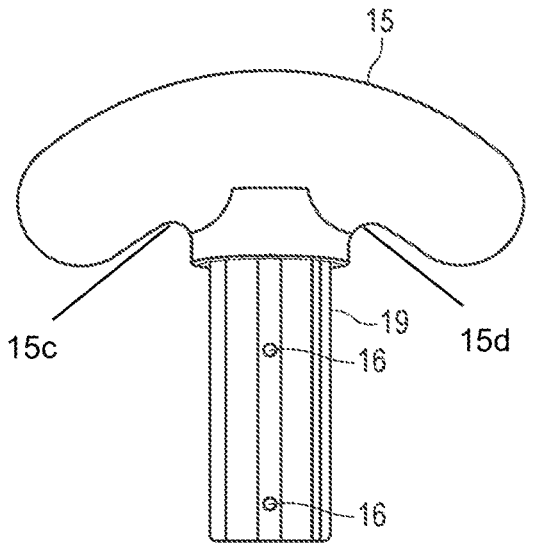
FIG. 3 shows a detailed view of one of the handles external to the roller bar to one embodiment of the present invention.
Figure 4:
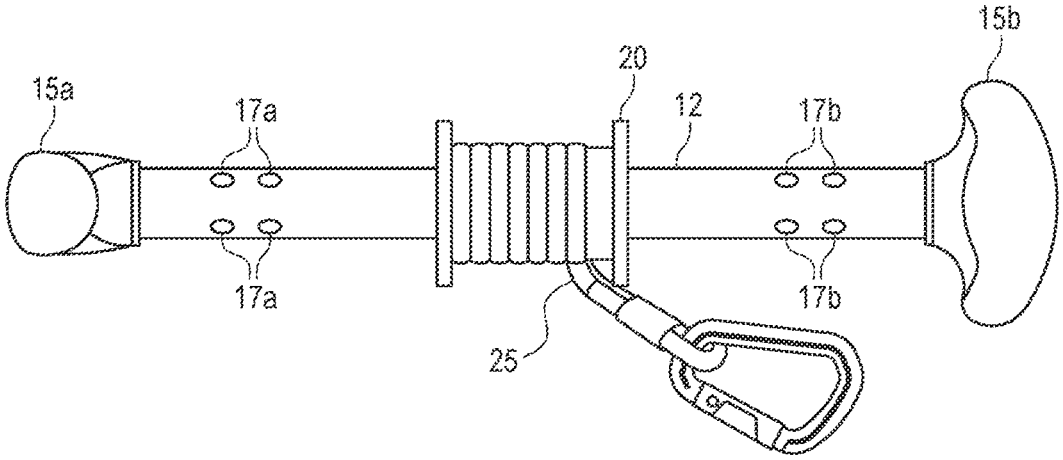
FIG. 4 shows a top-down view of the remedial deviation device with the handles in out phase position according to one embodiment of the present invention.

Referring now to FIG. 2, there is shown an exploded view of device 10 with handles 15 shown as external to the roller bar 12. As shown in FIG. 3 handles 15 include a lower portion 19 structured and arrange to mate with and slide into the ends of roller bar 12. Lower portion 19 includes apertures 16 located to align with holes 17*a* and 17*b* respectively to releasable affix handles 15 to roller bar 12. Multiple sets of apertures 16 and holes 17*a* and 17*b* are included so that user may affix the handles at 90 degrees relative to each other or inline depending upon a preferred training session.

In some embodiments handles 15 are made from hard plastic or metal material and in some embodiments they are made from soft malleable materials ideal for form fitting to a user's hands. Likewise, roller bar 12 can be formed from a hard metallic or plastic material, and can include a form fitting malleable material, such as a Neoprene® like material, according to the user's preferred training regimen.

It will be apparent to one of skill in the art that described herein is a novel remedial deviation device as disclosed herein. While the invention has been described with reference to specific preferred embodiments, it is not limited to these embodiments. The invention may be modified or varied in many ways and such modifications and variations as would be obvious to one of skill in the art are within the scope and spirit of the invention and are included within the scope of the following claims.

The invention claimed is:

1. A remedial deviation training device, the device comprising:

a central roller bar;

a pair of handles adjustably affixed to the roller bar, where each one of the pair of handles is disposed at a respective distal end of the roller bar, and the pair of handles are configured to selectively move between a first configuration where the pair of handles are aligned with each other and a second configuration where the pair of handles are rotationally offset by 90 degrees, wherein the pair of handles have a substantially arcuate shape perpendicular to the roller bar optimally sized for remedial deviation training of a user's hands, wrists and forearms; and a spool affixed to the roller bar substantially central thereto, the spool structured and arranged to releasably secure a tether cord configured to hold a weighted object having a predetermined weight, wherein, upon a user's rotation of the pair of handles along a central axis of the roller bar, the spool rotates along with the roller bar and collects the tether cord in a rolled up manner so that the user may train his or her hands, wrists and forearms, by rotating the pair of handles in one direction to elevate the weighted object and then reverse the rotation of the pair of handles bar and lower the weighted object.

2. The remedial deviation training device according to claim 1, wherein the roller bar is a hollow cylinder having open ends.

3. The remedial deviation training device according to claim 2, wherein each one of the pair handles includes a mating portion for adjustably connecting with the open distal ends of the roller bar.

4. The remedial deviation training device according to claim 3, wherein the roller bar includes a set of bar notches proximally located near the distal ends thereof.

5. The remedial deviation training device according to claim 4, wherein the mating portion includes a set of adjustable protuberances for respectively mating with the set of roller bar notches.

6. The remedial deviation training device according to claim 5, wherein the set of bar notches and the set of adjustable protuberances are structured and arranged so that the handles can be releasably affixed to the roller bar out of phase relative to one another.

7. The remedial deviation training device according to claim 5, wherein the set of adjustable proturbances are spring loaded.

8. The remedial deviation training device according to claim 1, wherein the pair of handles are formed of a malleable material.

9. The remedial deviation training device according to claim 1, wherein the pair of handles include ergonomic finger grips.

10. The remedial deviation training device according to claim 1, wherein the pair handles are configured to be locked in the first configuration or locked in the second configuration.

11. A remedial deviation training device, the device comprising:

a central roller bar that is a hollow cylinder having open ends;

a pair of handles adjustably affixed to the roller bar and each of the pair of handles is disposed at a respective distal end of the roller bar, wherein each one of the pair handles includes a mating portion for adjustably connecting with the open distal ends of the roller bar, and a set of bar notches proximally located near the distal ends thereof, the pair of handles formed having a substantially arcuate shape perpendicular to the roller bar optimally sized for remedial deviation training of a user's hands, wrists and forearms; and a spool, releasably affixed to the roller bar substantially central thereto, the spool structured and arranged to releasably secure a tether cord designed to hold a weighted object having a predetermined weight, wherein, upon a user's rotation of the handles along a central axis of the roller bar, the spool rotates along with the roller bar and collects the cord in a rolled up manner so that the user may train his or her hands, wrists and forearms, by rotating the handles in one direction to elevate the weighted object and then reverse the rotation of the handles bar and lower the weighted object.

12. The remedial deviation training device according to claim 11, wherein the mating portion includes a set of adjustable protuberances for respectively mating with the set of roller bar notches.

13. The remedial deviation training device according to claim 12, wherein the set of bar notches and the set of adjustable protuberances are structured and arranged so that the handles can be releasably affixed to the roller bar out of phase relative to one another.

14. The remedial deviation training device according to claim 13, wherein the set of adjustable proturbances are spring loaded.

15. The remedial deviation training device according to claim 11, wherein the pair of handles are formed of a malleable material.

16. The remedial deviation training device according to claim 11, wherein the pair of handles include ergonomic finger grips.

* * * * *